US009870911B2

(12) United States Patent
Guna

(10) Patent No.: US 9,870,911 B2
(45) Date of Patent: Jan. 16, 2018

(54) METHOD AND APPARATUS FOR PROCESSING IONS

(71) Applicant: DH Technologies Development PTE Ltd., Singapore (SG)

(72) Inventor: Mircea Guna, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/104,833

(22) PCT Filed: Nov. 20, 2014

(86) PCT No.: PCT/IB2014/002550
§ 371 (c)(1),
(2) Date: Jun. 15, 2016

(87) PCT Pub. No.: WO2015/097504
PCT Pub. Date: Jul. 2, 2015

(65) Prior Publication Data

US 2017/0032953 A1 Feb. 2, 2017

Related U.S. Application Data

(60) Provisional application No. 61/920,333, filed on Dec. 23, 2013.

(51) Int. Cl.
*H01J 49/04* (2006.01)
*H01J 49/42* (2006.01)
(Continued)

(52) U.S. Cl.
CPC ..... *H01J 49/4205* (2013.01); *H01J 49/009* (2013.01); *H01J 49/0031* (2013.01); *H01J 49/061* (2013.01)

(58) Field of Classification Search
CPC .... H01J 49/004; H01J 49/4225; H01J 49/427; H01J 49/42; H01J 49/0031;
(Continued)

(56) References Cited

U.S. PATENT DOCUMENTS 6,028,308 A * 2/2000 Hager ..... H01J 49/4225 250/282
6,153,880 A * 11/2000 Russ, IV ..... H01J 49/4215 250/292
(Continued)

FOREIGN PATENT DOCUMENTS

JP 2008-084850 A 4/2008

OTHER PUBLICATIONS

International Search Report and Written Opinon for PCT/IB2014/002550 dated Apr. 20, 2015.

*Primary Examiner* — David A Vanore

(57) ABSTRACT

Methods and apparatus for operating a mass spectrometer are described. In various aspects, ions of a mass range of interest may be mass-selectively ejected from an accumulation ion trap into a multi-ion trap structure. Each ion trap of the multi-ion trap structure may be configured to confine ions within a portion of the mass range of interest. The ions may be simultaneously scanned from the ion traps of the multi-ion trap structure for concurrent detection at a detector component.

15 Claims, 7 Drawing Sheets

(51) Int. Cl.
*H01J 49/00* (2006.01)
*H01J 49/06* (2006.01)

(58) Field of Classification Search
CPC ..... H01J 49/0045; H01J 49/063; H01J 49/10; H01J 49/423; H01J 49/425; H01J 49/4295; H01J 49/00; H01J 49/0009; H01J 49/0063; H01J 49/009; H01J 49/022; H01J 49/0409; H01J 49/067; H01J 49/105; H01J 49/107; H01J 49/36; H01J 49/401; H01J 49/4215; H01J 49/422
USPC ..... 250/282, 281, 288, 292, 287, 283, 286, 250/252.1, 285, 290, 291, 293, 299, 250/423 P, 423 R
See application file for complete search history.

(56) References Cited

U.S. PATENT DOCUMENTS 6,177,668 B1 * 1/2001 Hager ..... H01J 49/004 250/281
6,184,522 B1 * 2/2001 Jolliffe ..... H01J 49/0409 250/288
6,504,148 B1 * 1/2003 Hager ..... H01J 49/4225 250/281
6,794,642 B2 * 9/2004 Bateman ..... H01J 49/42 250/281
6,870,153 B2 * 3/2005 Goodall ..... H01J 49/105 250/281
6,872,939 B2 * 3/2005 Bateman ..... H01J 49/421 250/282
6,909,089 B2 * 6/2005 Londry ..... H01J 49/4225 250/281
6,967,323 B2 * 11/2005 Hashimoto ..... H01J 49/004 250/281
7,019,290 B2 * 3/2006 Hager ..... H01J 49/4225 250/282
7,060,972 B2 * 6/2006 Hager ..... H01J 49/4225 250/282
7,847,243 B2 * 12/2010 Makarov ..... H01J 49/004 250/281
8,101,910 B2 * 1/2012 Loboda ..... H01J 49/0031 250/281
8,674,299 B2 * 3/2014 Hirabayashi ..... H01J 49/004 250/281
9,018,580 B2 * 4/2015 Lemoine ..... G01N 33/6848 250/282
9,576,779 B2 * 2/2017 Guna ..... H01J 49/0031
2003/0189171 A1 * 10/2003 Londry ..... H01J 49/4225 250/292
2003/0222211 A1 12/2003 Okumura et al.
2004/0079873 A1 * 4/2004 Bateman ..... H01J 49/42 250/281
2004/0245455 A1 * 12/2004 Reinhold ..... H01J 49/427 250/288
2006/0091308 A1 * 5/2006 Boyle ..... H01J 49/107 250/285
2008/0067349 A1 * 3/2008 Moskovets ..... H01J 49/009 250/287
2010/0176291 A1 * 7/2010 Hager ..... H01J 49/004 250/283
2012/0091330 A1 * 4/2012 Coon ..... H01J 49/004 250/282
2012/0205535 A1 8/2012 Lemoine et al.
2013/0200256 A1 * 8/2013 Kanai ..... H01J 49/00 250/252.1
2015/0194296 A1 * 7/2015 Verenchikov ..... H01J 49/0027 250/282

* cited by examiner

METHOD AND APPARATUS FOR PROCESSING IONS

RELATED APPLICATION

This application claims priority to U.S. Provisional Application No. 61/920,333, filed on Dec. 23, 2013, which is incorporated herein by reference in its entirety.

FIELD

The present teachings generally relate to mass spectrometry and, more particularly, to methods and apparatus for processing and analyzing ions using multiple ion traps.

INTRODUCTION

Mass spectrometry (MS) is an analytical technique for determining the elemental composition of test substances that has both quantitative and qualitative applications. For example, MS can be useful for identifying unknown compounds, determining the isotopic composition of elements in a molecule, and determining the structure of a particular compound by observing its fragmentation, as well as for quantifying the amount of a particular compound in a sample.

A typical mass spectrometer system generally consists of at least the following three components: an ion source, a mass analyzer, and a detector. In general, the compound to be analyzed is introduced into the system in liquid or gas form and the ion source operates to ionize the compounds, for instance, by adding or subtracting charges to make neutral molecules of the compound into charged ions. The mass analyzer manipulates and separates the ions according to their mass-to-charge (m/z) ratios within the mass spectrometer by using electric and/or magnetic fields. If the charge of a given ion is known, then the molecular mass of that ion, and thus the neutral analyte molecule, may be determined based on the ions contacting or passing by the detector. For example, the detector may record an induced charge or current when an ion passes by or hits a surface of the detector. In another example, a detector may produce a signal during the course of a scan based on where the mass analyzer is in the scan (e.g., the mass-to-charge ratio (m/z) of the ions), thus producing a mass spectrum of ions as a function of m/z.

Numerous types of mass spectrometers have been developed, each with their own set of advantages, disadvantages, and analytical applications. For example, ion trap mass spectrometers use electrode structures to form trapping chambers (e.g., "ion traps") to contain ions introduced into the mass spectrometer by means of electrostatic and electrodynamic fields. An example of an ion trap mass spectrometer is a linear 2D quadrupole ion trap mass spectrometer. This type of mass spectrometer operates by superimposing a high-frequency (e.g., radio frequency (RF)) voltage onto a direct current (DC) voltage of four rod electrodes to form a quadrupole electrodynamic field that confines the ions radially. Axially, ions are confined using DC voltage barriers provided by end side lenses. Trapped ions are cooled through collisions with the background gas molecules and ejected axially or radially in a mass-selective fashion by the ramping of the amplitude of the main RF drive, to bring ions of increasingly higher m/z into resonance with a single-frequency dipolar auxiliary signal, applied between two opposing rods.

The performance and capabilities of mass spectrometers may be evaluated based on various characteristics, such as accuracy, mass resolution, data acquisition rate, scan rate (for scanning mass spectrometers), and/or duty cycle. The characteristics of a mass spectrometer are interrelated in that modification of the mass spectrometer and/or techniques for using the mass spectrometer to change a characteristic (e.g., mass resolution) may have an effect on other characteristics (e.g. duty cycle). For instance, the duty cycle can be inversely proportional to mass resolution, because slower scan rates and smaller step size or longer acquisition times (in case of Fourier Transform Mass Spectrometry) are required for higher resolution. The duty cycle is the portion of ions of a particular m/z produced in the ion source that are effectively analyzed, and is generally expressed as a ratio or percentage. For example, a quadrupole mass spectrometer detecting only one specific ion has a duty cycle of 100%. In scan mode, the same quadrupole mass spectrometer scanning the mass analyzer to detect an m/z range will exhibit a duty cycle that is decreased according to the proportion of the observation time spent for each ion. As such, a quadrupole mass spectrometer scanning over 1000 atomic mass units (amu) will have a duty cycle of $1/1000$ or 0.1%.

In conventional scanning mass analyzers, the mass resolution of an ion trap may depend on the scan rate. For instance, the slower the scan rate the better the mass resolution. However, decreased scan rates may cause increased cycle times for the ion traps, which may lead, for example, to a loss of measurement precision, increased data acquisition times, and loss of chromatographic resolution.

Accordingly, a need exists to improve the overall data acquisition rate of a mass spectrometer without negatively affecting other performance characteristics of the mass spectrometer.

SUMMARY

Apparatus, systems, and methods in accordance with the applicant's present teachings allow for the mass selective transmission of ions having selected mass ranges to a plurality of downstream ion traps (e.g., an ion trap array), and/or to differentially or simultaneously detect the ions confined in each of the plurality of ion traps. The ion trap arrays may be arranged in various configurations, including, one-dimensional (e.g., linear) arrays and two-dimensional (2D) arrays, all by way of non-limiting example. In some embodiments, ions within a broad m/z range of interest can be confined in an accumulation ion trap configured to trap ions encompassing the entire m/z range, and sequentially transferred (e.g., scanned in a mass-selective fashion) out of the accumulation ion trap into a plurality of downstream ion traps for further simultaneous processing and/or detection.

In one aspect, a method for processing ions in a mass spectrometer system is disclosed that includes confining a plurality of ions in an accumulation ion trap and sequentially transmitting a first group of ions of the plurality of ions from the accumulation ion trap into a first ion trap. A second group of ions of the plurality of ions from the accumulation ion trap may be sequentially transmitted into a second ion trap different from the first ion trap. The first group of ions can comprise ions having a mass range different than the second group of ions. The first group of ions may be confined in the first ion trap and the second group of ions may be confined in the second ion trap. Ions may be simultaneously transmitted out of the first ion trap and the second ion trap for detection by at least one detector.

In some aspects, a mass spectrometer system is disclosed that includes an ion source configured to generate a plurality of ions and an accumulation ion trap configured to trap the plurality of ions generated by the ion source. A first ion trap may be configured to receive a first of group ions of the plurality of ions transmitted by the accumulation ion trap. A second ion trap may be configured to receive a second group of ions of the plurality of ions transmitted by the accumulation ion trap. The mass spectrometer system may further include at least one detector for detecting ions transmitted from at least one of the first and second ion traps and a controller operatively coupled to the accumulation ion trap and the first and second ion traps, the controller configured to: i) sequentially transmit the first group of ions from the accumulation ion trap into the first ion trap and the second group of ions from the accumulation ion trap into the second ion trap, wherein the first group of ions comprises ions having a mass range different than the second group of ions, and ii) simultaneously transmit ions out of the first ion trap and the second ion trap for detection by the at least one detector.

In some aspects, the step of sequentially transmitting the first group of ions and the second group of ions from the accumulation ion trap may further include sequentially transmitting a third group of ions of the plurality of ions from the accumulation ion trap into a third ion trap different from the first and second ion traps, wherein the third group of ions comprise ions having a mass range different than the first and second group of ions. In some embodiments, the third group of ions may be confined in the third ion trap and the ions may be transmitted out of the third ion trap for detection by the at least one detector simultaneous with the transmission of ions out of the first ion trap and the second ion trap.

In some aspects, a mass spectrometer system may include an ion source configured to generate a plurality of ions and an accumulation ion trap configured to trap the plurality of ions generated by the ion source. A plurality of ion traps may be configured to receive a portion of a mass range of the plurality of ions. A detector component may be provided for detecting ions transmitted from the plurality of ion traps. The mass spectrometer system may also include a controller coupled to the accumulation ion trap and the plurality of ion traps. In some embodiments, the controller may be configured to mass-dependently eject ions from the accumulation ion trap, adjust the voltage bias of an ion selector to transmit a portion of the plurality of ions being mass-dependently ejected into a corresponding one of the plurality of ion traps based on a mass range of the plurality of ions being mass-dependently ejected, and/or simultaneously transmit ions out of the plurality of ion traps for detection at the at least one detector.

In some embodiments, the plurality of ion traps may include at least five ion traps. In some embodiments, the plurality of ion traps may include at least ten ion traps. In some embodiments, the ion traps may include radio frequency (RF) ion traps.

In some aspects, the ions may be transmitted out of the accumulation trap by mass selectively scanning the accumulation ion trap so as to eject the ions along an ion beam pathway. In some embodiments, the ions may be mass selectively scanned out of the accumulation ion trap using mass selective axial ejection (MSAE). In some embodiments, the ions may be mass selectively scanned out of the accumulation ion trap using mass selective radial ejection. In some embodiments, the ions are sequentially transmitted from the accumulation ion trap from a lowest mass range to a highest mass range.

In some aspects, an ion selector or deflector may be configured to deflect ions from the ion beam scanned out of the accumulation ion trap into one of the plurality of ion traps (e.g., the first ion trap, the second ion trap, the third ion trap, etc.). In an aspect, a lens may be arranged between the accumulation ion trap and the deflector that is configured to focus the ion beam pathway on or into the ion selector or deflector. In some aspects, the ion selector may be configured to deflect ions into the first ion trap for a first duration of time, into the second ion trap for a second duration of time, and so on for each ion trap of the plurality of ion traps. In some embodiments, for example, each of the plurality of ion traps may be associated with a deflector (or an ion selector) configured to deflect ions traveling in the ion beam into the corresponding ion trap of the plurality of ion traps. For instance, a first deflector may be associated with the first ion trap and may be configured to deflect ions from the ion beam into the first ion trap during a first duration of time, a second deflector may be associated with the second ion trap and may be configured to deflect ions from the ion beam into the second ion trap during a second duration of time (e.g., after the first time duration), and so on for each ion trap of the plurality of ion traps.

In some aspects, the at least one deflector comprises a pair of electrodes having a DC bias applied therebetween. The controller may be configured to adjust the at least one deflector to deflect the first group of ions from the ion beam pathway into the first ion trap by maintaining a first DC bias between said electrodes and to deflect the second group of ions from the ion beam pathway into the second ion trap by maintaining a second DC bias between said electrodes. The controller may similarly adjust the voltage of the electrodes to direct ions from the ion beam into the other ion traps of the plurality of ion traps.

In some aspects, the at least one detector component may include a plurality of detectors. In some aspects, the plurality of detectors may comprise one detector for each of the plurality of ion traps. In some aspects, the detector component is configured to detect ions from the first ion trap and the second ion trap based on a location on the detector component that receives the ions.

In some aspects, a mass spectrometer system may comprise an ion source configured to generate a plurality of ions and an accumulation ion trap configured to trap the plurality of ions generated by the ion source. The system can also include a linear array of ion traps comprising a first ion trap configured to receive a first group of ions of the plurality of ions transmitted by the accumulation ion trap, and a second ion trap upstream from the first ion trap and configured to receive a second group of ions of the plurality of ions transmitted by the accumulation ion trap. At least one detector component may be configured to detect ions transmitted from at least one of the first and second ion traps. The system may include a controller operatively coupled to the accumulation ion trap and the first and second ion traps. The controller may be configured to sequentially transmit the first group of ions from the accumulation ion trap through the second ion trap and into the first ion trap and the second group of ions from the accumulation ion trap into the second ion trap, wherein the first group of ions comprises ions having a mass range different than the second group of ions. The controller can also be configured to transmit ions out of the first ion trap for detection by the at least one detector, and transmit ions out of the second ion trap (e.g., and through the first ion trap) for detection by the at least one detector. In some aspects, the system may further include a third ion trap, wherein the controller is configured to sequentially transmit a third group of ions of the plurality of ions from the accumulation ion trap into the third ion trap different from the first and second ion traps, wherein the third group of ions comprise ions having a mass range different than the first and second group of ions.

In some aspects, the system may further include a first lens disposed downstream of the first ion trap and a second lens arranged between the first ion trap and the second ion trap. The controller may be configured to adjust the voltage of the first lens to prevent ions from being transmitted out of the first ion trap and to adjust the voltage of the second lens to prevent ions from being transmitted out of the first and second ion traps. The controller may further be configured to adjust the voltage of the first lens to allow the first group of ions to be transmitted out of the first ion trap for detection by the at least one detector component while the second group of ions are being transmitted into the second ion trap.

In accordance with various aspects of the applicant's present teachings, a mass spectrometer system is disclosed that comprises an ion source configured to generate a plurality of ions, an accumulation ion trap configured to trap the plurality of ions generated by the ion source, a plurality of ion traps configured to receive a portion of a mass range of the plurality of ions, and at least one detector component for detecting ions transmitted from the plurality of ion traps. The system also includes a controller coupled to the accumulation ion trap and the plurality of ion traps configured to mass-dependently eject ions from the accumulation ion trap, selectively adjust an ion selector so as to transmit a portion of the plurality of ions being mass-dependently ejected into a corresponding one of the plurality of ion traps based on a mass range of the plurality of ions being mass-dependently ejected, and simultaneously transmit ions out of the plurality of ion traps for detection at the at least one detector.

In some aspects, the plurality of ion traps comprises at least ten ion traps (e.g., RF ion traps). In some aspects, the ions can be sequentially transmitted from the accumulation ion trap from a lowest mass range to a highest mass range. The multiple ion traps can be arranged linearly (e.g., along a direction of propagation of the ion beam) or in a two-dimensional array.

In various aspects, the controller is configured to adjust the voltage bias of the ion selector over time based on a time duration indicated the mass range of the plurality of ions being mass-dependently ejected from the accumulation ion trap.

BRIEF DESCRIPTION OF THE DRAWINGS

A detailed description of various embodiments is provided herein below with reference, by way of example, to the following drawings. It will be understood that the drawings are exemplary only and that all reference to the drawings is made for the purpose of illustration only, and is not intended to limit the scope of the embodiments described herein below in any way. For convenience, reference numerals may also be repeated (with or without an offset) throughout the figures to indicate analogous components or features.

DETAILED DESCRIPTION

Those skilled in the art will understand that the methods, systems, and apparatus described herein are non-limiting exemplary embodiments and that the scope of the applicant's disclosure is defined solely by the claims. While the applicant's teachings are described in conjunction with various embodiments, it is not intended that the applicants' teachings be limited to such embodiments. On the contrary, the applicant's teachings encompass various alternatives, modifications, and equivalents, as will be appreciated by those of skill in the art. The features illustrated or described in connection with one exemplary embodiment may be combined with the features of other embodiments. Such modifications and variations are intended to be included within the scope of the applicants' disclosure.

The present teachings generally relate to mass spectrometry methods and systems that provide for the mass selective transmission ions across a range of m/z into one of a plurality of downstream ion traps (e.g., a one- or two-dimensional ion trap array). In various aspects, the plurality of downstream ion traps, each of which can receive a selected portion of the range of m/z, can be operated so as to process in parallel the ions within each particular trap and/or allow for the simultaneous detection of the ions from each of the plurality of traps. In some aspects, methods and systems in accordance with the present teachings can provide for improved resolution while nonetheless decreasing processing times. By way of example, the scan rate of each of the plurality of parallel traps may be slowed while maintaining overall processing times while operating the plurality of traps in parallel.

Figure 1:
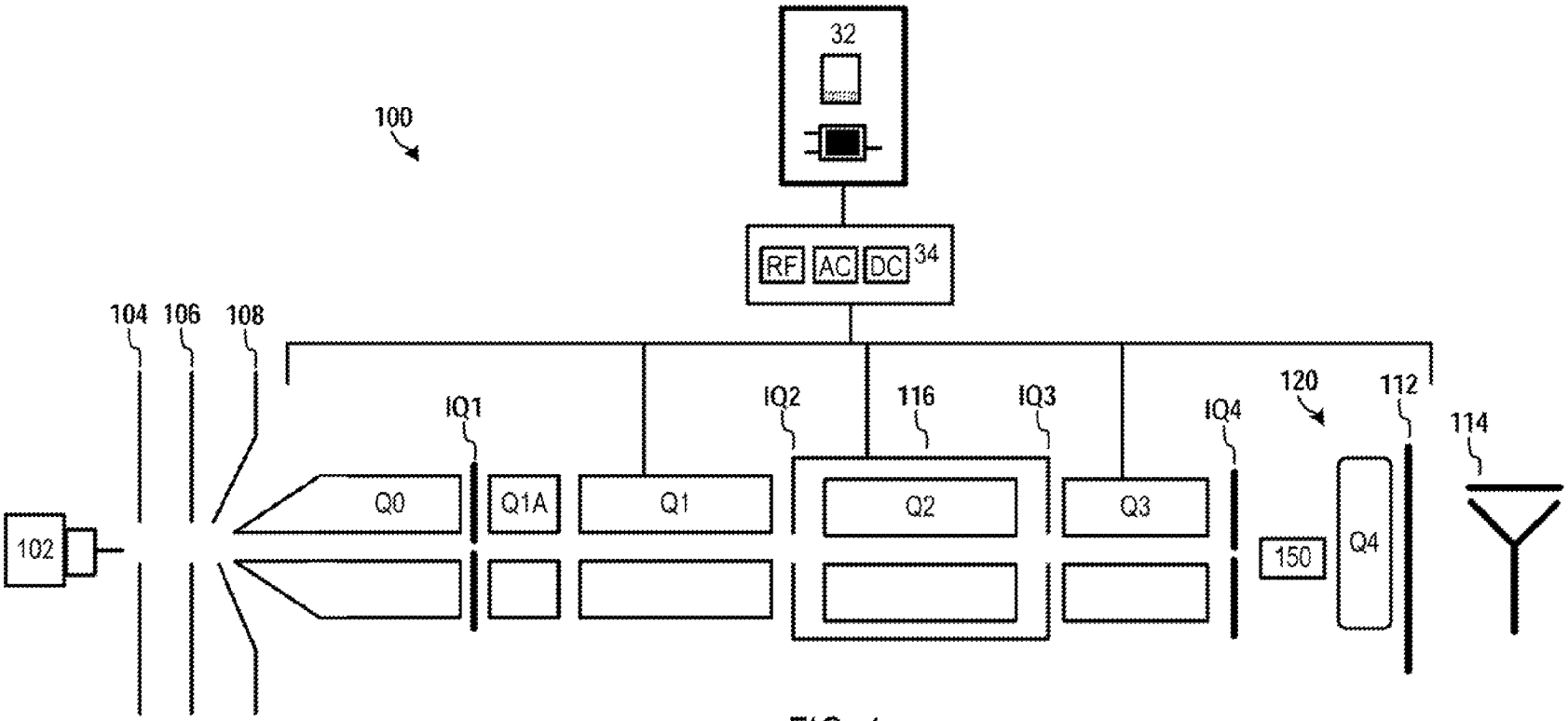
FIG. 1, in schematic diagram, depicts an illustrative mass spectrometer system according to various aspects of the applicant's teachings.

While the systems, devices, and methods described herein can be used in conjunction with many different mass spectrometer systems, an exemplary mass spectrometer system 100 for such use is illustrated schematically in FIG. 1. It should be understood that the mass spectrometer system 100 represents only one possible mass spectrometer instrument for use in accordance with embodiments of the systems, devices, and methods described herein, and mass spectrometers having other configurations can all be used in accordance with the systems, devices and methods described herein as well.

In some embodiments, a mass spectrometer as disclosed in an article entitled "Product ion scanning using a Q-q-$Q_{linear}$ ion trap (Q TRAP®) mass spectrometer," authored by James W. Hager and J. C. Yves Le Blanc and published in Rapid Communications in Mass Spectrometry (2003; 17: 1056-1064) can be modified in accordance with the present disclosure to implement various aspects of the applicant's teachings.

As shown in the exemplary embodiment depicted in FIG. 1, the mass spectrometer system 100 (the "system") may include an ion source 102, one or more detectors 114, one or more mass analyzers (e.g., Q0, Q1, Q2, and Q3), and a multi-ion trap structure 120. Though the exemplary system 100 includes four elongated sets of rods (Q0, Q1, Q2, and Q3, which is also referred to as the accumulation trap in the depicted system 100), more or fewer mass analyzer elements can be included. Additionally, any number of additional ion optical elements can be included. By way of example, the exemplary system 100 includes orifice plates IQ1 after rod set Q0, IQ2 between Q1 and Q2, and IQ3 between Q2 and Q3. As shown in FIG. 1, multi-ion trap structure 120 may be arranged between Q3 and the detector(s) 114, with orifice plates IQ4 arranged between Q3 and the multi-ion trap structure 120. However, it will be appreciated in light of the present teachings that the multi-ion trap structure 120 can replace Q3, for example, such that the multi-ion trap structure 120 receives the ions directly from Q2. Moreover, though the elongated rod sets Q0 and Q2, for example, are generally referred to herein as quadrupoles (that is, they have four rods), the elongated rod sets can be any other suitable multipole configurations, for example, hexapoles, octapoles, etc.

As will be appreciated by a person skilled in the art, Q0, Q1, Q2, and Q3 can be disposed in adjacent chambers that are separated, for example, by aperture lenses IQ1, IQ2, and IQ3, and are evacuated to sub-atmospheric pressures. By way of example, a mechanical pump (e.g., a turbo-molecular pump) can be used to evacuate the vacuum chambers to appropriate pressures. The various components of the mass spectrometer system 100 can be coupled with one or more power supplies 34 to receive RF and/or DC voltages selected to configure the quadrupole rod sets for various different modes of operation depending on the particular mass spectrometry (MS) application. As will be appreciated by a person skilled in the art, ions can be trapped radially in any of Q0, Q1, Q2, and Q3 by RF voltages applied to the rod sets, and axially through the application of RF and/or DC voltages applied to various components of the mass spectrometer system 100, as discussed in detail below.

The ion source 102 can be any known or hereafter developed ion sources and modified in accordance with the present teachings. Non-limiting examples of ion sources suitable for use with the present teachings include atmospheric pressure chemical ionization (APCI) sources, electrospray ionization (ESI) sources, continuous ion source, a pulsed ion source, an inductively coupled plasma (ICP) ion source, a matrix-assisted laser desorption/ionization (MALDI) ion source, a glow discharge ion source, an electron impact ion source, a chemical ionization source, or a photo-ionization ion source, among others.

During operation of the mass spectrometer system 100, ions generated by the ion source 102 can be extracted into a coherent ion beam by passing the ions successively through apertures in aperture plate 104, an orifice plate 106, and a skimming plate ("skimmer") 108. In various embodiments, an intermediate pressure chamber can be located between the orifice plate 106 and the skimmer 108 and can be evacuated to a pressure approximately in the range of about 1 Torr to about 4 Torr, though other pressures can be used for this or for other purposes. In some embodiments, upon passing through the skimmer 108, the ions can traverse one or more additional vacuum chambers and/or quadrupoles (e.g., a QJet® quadrupole) to provide additional focusing of and finer control over the ion beam using a combination of gas dynamics and radio frequency fields.

Ions generated by the ion source 102 can then enter the quadrupole rod set Q0, which can be operated as a collision focusing ion guide, for instance by collisionally cooling ions located therein. Q0 can be situated in a vacuum chamber and can be associated with a pump operable to evacuate the chamber to a pressure suitable to provide collisional cooling. For example, the vacuum chamber can be evacuated to a pressure approximately in the range of about $0.5\times10^{-5}$ Torr to about $1\times10^{-4}$ Torr, though other pressures can be used for this or for other purposes. Quadrupole rod set Q0 can be used in RF-only mode to operate in conjunction with the pressure of vacuum chamber as a collimating quadrupole. A lens IQ1 can be disposed between the vacuum chamber of Q0 and the adjacent chamber to isolate the two chambers.

After passing through Q0, the ions can enter the adjacent quadrupole rod set Q1, which can be situated in a vacuum chamber that can be evacuated to a pressure approximately in the range of about 40 milliTorr to about 80 milliTorr, though other pressures can be used for this or for other purposes. As will be appreciated by a person of skill in the art, the quadrupole rod set Q1 can be operated as a conventional transmission RF/DC quadrupole mass filter that can be operated to select an ion of interest and/or a range of ions of interest. By way of example, the quadrupole rod set Q1 can be provided with RF/DC voltages suitable for operation in a mass-resolving mode. As will be appreciated by a person skilled in the art, taking the physical and electrical properties of Q1 into account, parameters for an applied RF and DC voltage can be selected so that Q1 establishes a quadrupolar field having an m/z passband. Ions having m/z ratios falling within the passband can traverse the quadrupolar field largely unperturbed. Ions having m/z ratios falling outside the passband, however, can be degenerated by the quadrupolar field into orbital decay, and thus, be prevented from traversing the quadrupole rod set Q1. It should be appreciated that this mode of operation is but one possible mode of operation for Q1. By way of example, the lens IQ2 between Q1 and Q2 can be maintained at a much higher offset potential than Q1 such that ions entering the quadrupole rod set Q1 be operated as an ion trap. In such a manner, the potential applied to the entry lens IQ2 can be selectively lowered such that ions trapped in Q1 can be accelerated (e.g., mass selectively scanned) into Q2.

In some embodiments, a set of RF-only stubby rods can be provided between neighboring pairs of quadrupole rod sets to facilitate the transfer of ions between quadrupoles. The stubby rods can serve as a Brubaker lens and can help prevent ions from undergoing orbital decay due to interactions with any fringing fields that may have formed in the vicinity of an adjacent lens, for example, if the lens is maintained at an offset potential. By way of non-limiting example, FIG. 1 depicts stubby rods Q1A between IQ1 and the rod set Q1 to focus the flow of ions into Q1. Stubby rods can also be included upstream and downstream of the elongated rod set Q2, for example.

Ions passing through the quadrupole rod set Q1 can pass through the lens IQ2 and into the adjacent quadrupole rod set Q2, which as shown can be disposed in a pressurized compartment 116 and can be configured to operate as a collision cell at a pressure approximately in the range of from about 1 mTorr to about 10 mTorr, for example, though other pressures can be used for this or for other purposes. A suitable collision gas (e.g., argon, helium, etc.) can be provided by way of a gas inlet (not shown) to fragment and/or thermalize ions in the ion beam. As will be appreciated by a person skilled in the art in light of the present teachings, ions can be transmitted through or confined within Q2 while being subject to various processes including, for example, collision induced dissociation (e.g., beam-type or resonant excitation) and/or ion-ion interactions (e.g., ETD). For example, Q2 can be configured to resonantly excite ions confined therein through the application of a suitable RF trapping voltage and an auxiliary excitation signal to the quadrupole rod set Q2 and/or the entrance and exit lenses IQ2 and IQ3. Q2 can also be configured to simultaneously contain ions of opposite polarities to allow for ion-ion reactions therebetween. For example, ion-ion reactions can be provided during mutual storage, in which ions of both polarities are simultaneously trapped within an ion trap, or in transmission mode, in which ions of one polarity are confined in Q2 while ions of the opposite polarity are passed therethrough. As is known generally in the art, the movement and excitation of ions in Q2 can be controlled, for example, via the application of various RF and DC potentials to Q2, IQ2, and IQ3. It should be further appreciated that these modes of operation are but some possible modes of operation for Q2. By way of example, Q2 can be configured to operate in RF/DC mass-resolving mode, trapping mode, or RF-only transmission mode.

Ions (e.g., precursor and/or product ions) that are transmitted by Q2 can pass into the adjacent quadrupole rod set Q3, which can be bounded upstream by IQ4. The quadrupole rod set Q3 can be situated in a vacuum chamber and can be associated with a pump operable to evacuate the chamber to a decreased operating pressure relative to that of Q2, for example, less than about $1\times10^{-4}$ Torr, although other pressures can be used for this or for other purposes. As will be appreciated by a person skilled in the art, Q3 can be operated in a number of manners, for example as a scanning RF/DC quadrupole, as a quadrupole ion trap, or as a linear ion trap. For example, a linear ion trap can refer to a trap in which a quadrupolar field is employed to confine ions in the radial dimension and an electric field (e.g., a DC electric field) at one or both ends of the trap is employed to confine the ions in the axial dimension.

In an exemplary aspect of the present teachings, a mass analyzer (e.g., Q3) may be operated as an accumulation ion trap that is configured to trap ions of a selected atomic mass range (or m/z) for subsequent ejection to the ion traps of the multi-ion trap structure 120 located downstream therefrom. It should be appreciated that the accumulation ion trap can comprise any ion trap known in the art and modified in accordance with the present teachings that can confine ions therein, and in some aspects, from which the trapped ions can be ejected in a mass-selective manner. Though Q3 is depicted as the accumulation ion trap in the exemplary embodiment depicted in FIG. 1, it will be appreciated that the multi-ion trap structure 120 can instead, for example, receive the ions therefrom directly from Q2 or any other upstream ion trap from which the ions can be sequentially scanned. By way of example, Q2 can both analyze (e.g., process) the ions and serve as the accumulation ion trap for distributing the ions into the downstream multi-ion trap structure 120. The subject mass range may include mass ranges known to those having ordinary skill in the art, including about 0.5 Daltons to about 5000 Daltons or any range therebetween.

In accordance with various aspects of the present teachings, ions may be sequentially transmitted (e.g., scanned in a mass-selective manner) out of Q3 (or Q2, Q1, or any other ion trap within mass spectrometer 100) using various known methods modified in accordance with the present teachings. For example, ions trapped in Q3 can be mass-selectively scanned via mass selective axial ejection (MSAE), as described in detail in U.S. Pat. No. 6,177,668, entitled "Axial Ejection in a Multipole Mass Spectrometer," which is hereby incorporated by reference in its entirety. By way of non-limiting example, a two-dimensional RF field may be formed in Q3 that radially contains trapped ions in the mass range of interest. A low voltage DC may be applied to the end lens IQ4 of Q3 to form a barrier field that axially contains ions within Q3. The barrier field and the RF field may interact in an extraction region adjacent to the end lens IQ4 to produce a fringing field. The ions confined in Q3 may be axially mass selectively ejected through the mixing of the degrees of freedom induced by the fringing fields and other anti-harmonicities in the vicinity of the end lens. For instance, the axial mass selective ejection may be performed by applying an auxiliary AC voltage to the end lens IQ4, or to the rods of Q3 themselves, or both, and by scanning either the auxiliary AC voltage and/or the RF voltage on the rod set of Q3. Alternatively, in some embodiments, ions trapped in Q3 can be mass-selectively scanned via mass selective radial ejection of ions, as described in detail in U.S. Pat. No. 5,420,425, entitled "Ion Trap Mass Spectrometer System and Method," which is hereby incorporated by reference in its entirety.

Ions mass-selectively transmitted out of Q3 can be directed to the multi-ion trap structure 120 (which can include a plurality of traps as discussed in detail below) using one or more deflectors, selectors, and/or other elements configured to direct ions from Q3 into the multiple ion traps of the multi-ion trap structure 120. For example, the depicted ion selector 150 can be, without limitation, an ion selector, a timed ion selector, and/or a deflector. As such, ions trapped in Q3 can be selectively transmitted to a particular ion trap of multi-ion trap structure 120. In some embodiments, additional electrical structures may be incorporated in the multi-ion trap structure 120 to facilitate the movement and/or confinement of ions within the multi-ion trap structure 120, including, without limitation, an electric multipole structure, an electric quadrupole, a DC quadrupole, an ion guide, an RF/DC ion guide, a lens, or any combination thereof. In some aspects, the multi-ion trap structure 120 can be situated in the same vacuum chamber as Q3, or a separate vacuum chamber and associated with a pump operable to evacuate the chamber to an operating pressure less than or equal to the operating pressure of Q3, for example, less than about $1\times10^{-4}$ Torr, although other pressures can be used for this or for other purposes.

One or more exit lenses 112 can be positioned between the multi-ion trap structure 120 and the detector(s) 114 to control ion flow into the detector 114 from the plurality of ion traps of the multi-ion trap structure. By way of example, ions may be mass-dependently ejected from multi-ion trap structure 120 using axial or radial ejection, as otherwise discussed herein. In some embodiments, ions may be scanned from the ion traps of multi-ion trap structure 120 in parallel for simultaneous or substantially simultaneous detection by the detector 114. In this manner, a range of ion masses may be analyzed concurrently by the mass spectrometer system 100. The detector 114 may include at least one detector that can be operated in a manner known to those skilled in the art in view of the systems, devices, and methods presently described herein. As will be appreciated by a person skill in the art, any known detector, modified in accord with the teachings herein, can be used to detect the ions. In some embodiments, the detector 114 can be an array of detectors, with each detector being configured to detect ions from one or more of the ion traps of the multi-ion trap structure 120. In some embodiments, the detector component 114 may include a location dependent detector configured to analyze ions based on the location that the ions hit or pass by (i.e., are "received" by) a surface of the detector.

The ion traps of the multi-ion trap structure 120 can have a variety of configurations, as well as being the same or different as others of the ion traps in the multi-ion trap structure 120. For example, each of the plurality of ion traps can be operated as a RF ion trap, though the operation parameters of each of the plurality of traps may differ from one another. In such embodiments, the trapping RF for multi-ion trap structure 120 may be provided using various arrangements of RF circuits, capacitors, and other elements known to those having ordinary skill in the art and modified in accordance with the present teachings. In a non-limiting example, the trapping RF may be provided using one main RF circuit and dividing capacitors positioned in a cascading arrangement, such as a capacitor with the highest RF level on a first ion trap, the second highest RF level on a second ion trap, and so on.

With continued reference to FIG. 1, the illustrative mass spectrometer system 100 can further include a controller 32 that is in electrical communication with the mass analyzers, detector 114, and/or other components of the mass spectrometer system 100, such as one or more power supplies 34 for applying control signals. In some embodiments, for example, the controller can provide control signals to the power supplies 34 to apply the requisite RF and/or DC voltages to the Q1, Q2, Q3, and/or any other electrical component of the mass spectrometer system 100.

The controller 32 can be implemented using known electrical components, such as suitable integrated circuits, and known engineering methods. For example, the controller 32 can include one or more processors, memory modules, communication modules for communicating with the detector 114, the power supplies 34, and other components of the mass spectrometer system 100 as well as software instructions for implementing the present teachings. In some embodiments, the controller 32 can further comprise one or more buffers and signal processing components that can facilitate the analysis of signals received from the detector 114.

Figure 2:
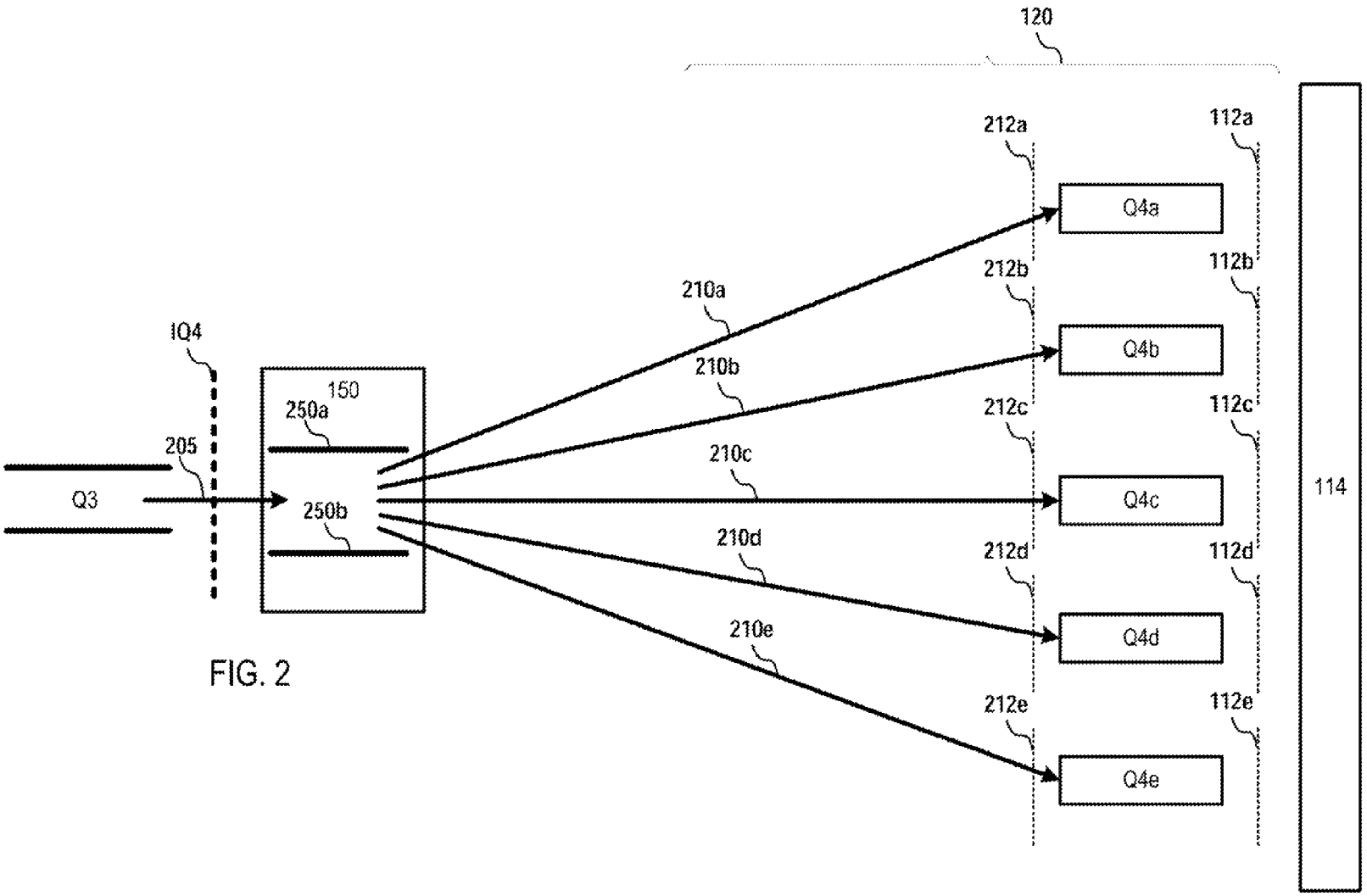
FIG. 2, in schematic diagram, depicts an illustrative multi-ion trap structure according to various aspects of the applicant's teachings.

With reference now to FIG. 2, an illustrative multi-ion trap structure is depicted according to various aspects of the applicant's present teachings. As shown in FIG. 2, the multi-ion trap structure 120 may include a plurality of ion traps Q4*a-e* that receive a portion of the ions transmitted by Q3. In some embodiments, ion traps Q3 and Q4*a-e* may be operatively coupled to controller 32. Each ion trap Q3, Q4*a-e* may be configured to confine ions within a particular mass range. In some embodiments, Q3 may be configured to confine ions over an entire mass range of interest, while each of the ion traps Q4*a-e* of the multi-ion trap structure 120 may be configured to confine a portion (e.g., a subset) of the entire range mass range of interest. In an illustrative and non-restrictive example, Q3 may be a linear ion trap configured to confine ions having a mass of about 30 Daltons to about 1000 Daltons, Q4*a* may be configured to confine ions having a mass range of about 30 Daltons to about 200 Daltons, Q4*b* may be configured to confine ions having a mass range of about 200 Daltons to about 400 Daltons, Q4*c* may be configured to confine ions having may be configured to confine ions having a mass range of about 400 Daltons to about 600 Daltons, Q4*d* may be configured to confine ions having a mass range of about 600 Daltons to about 800 Daltons, and Q4*e* a mass range of about 800 Daltons to about 1000 Daltons.

It should be appreciated that multi-ion trap structures configured according to various aspects of the present teachings are not limited to the number of traps and/or the mass ranges of ion traps depicted in FIG. 2 and/or described in association therewith, as this is only for illustrative purposes only. Rather, multi-ion trap structures in accordance with the present teachings may include more or less ion traps and/or may be configured to confine ions of different masses and/or mass ranges, including overlapping mass ranges. In some embodiments, the number and/or configuration of ion traps Q4*a-e* may be structured so as to minimize the number and/or residence time of ions in each trap. It will further be appreciate that although Q4 is depicted as an array of ion traps Q4*a-e*, the present teachings a are not so limited. Ion traps Q4*a-e* may be arranged in any form capable of operating according to the present teachings, including, without limitation, axially aligned (e.g., in a line), multi-dimensional array (e.g., two-dimensional or three dimensional), a circular form, a curved form, a square form, a rectangular form, in series, in parallel, and/or any combination thereof.

With specific reference again to FIG. 2, ions can be mass-selectively ejected from Q3 in an ion beam 205, as otherwise discussed herein. For instance, ions confined in Q3 can be mass-selectively scanned via MSAE, or mass-selectively scanned via radial ejection of ions, as described above. However, embodiments are not so limited, as ions may be mass-selectively ejected from Q3 using any technique known in the art and modified in accordance with the present teachings. In various aspects, the ions may be sequentially scanned out of Q3 into ion traps Q4*a-e* in a sequence from low mass (or low m/z) to high mass (or high m/z).

It should be appreciated that the mass range of the ions in the ion beam 205 (e.g., at a given time) may be generally known based on the scan parameters utilized to scan the ions from Q3. For instance, during a first time duration, the mass range of the ions may be known or determined to be in a first mass range (e.g., the lowest mass range of ions trapped in Q3). After the first time duration expires, the mass range of the ions may be a second mass range (e.g., the second-lowest mass range) during a second time duration, and so on until the entire mass range of ions has been scanned from Q3. In a non-limiting example in which Q3 confines a mass range of ions of about 30 Daltons to about 1000 Daltons, during the first time duration (e.g., about 1 ms), the ion beam 205 may comprise ions having a mass range of about 30 Daltons to about 200 Daltons (i.e., the first mass range). For the second time duration (e.g., about 1 ms), the ion beam 205 may comprise ions having a mass range of about 200 Daltons to about 400 Daltons (i.e., the second mass range), and so on until the entire mass range of ions has been scanned from Q3. Embodiments are not limited to the time durations and/or mass ranges described herein, as these are for illustrative purposes only. Indeed, the time durations and/or mass ranges capable of operating according to some embodiments is contemplated herein.

As noted above, the ion selector 150 may be configured to mass-dependently select and/or deflect ions from the ion beam into the individual ion traps Q4*a-e* of the multi-ion trap structure 120. In some embodiments, the ion selector 150 may include a plurality of selectors and/or deflectors configured to select a predetermined range of masses and to deflect them toward corresponding ion traps Q4*a-e*. The ion selector 150 may include, without limitation, ion selectors, ion deflectors, ion mirrors, reflectrons, multipole electrical elements, ion guides, timed ion selectors (TIS), or the like that are configured to mass-dependently select and/or deflect ions toward the ion traps Q4*a-e*. For example, the voltage applied to components of the ion selector 150 may be varied in order to deflect ions of a particular mass range into the corresponding ion trap Q4*a-e*.

For example, in some aspects, the ion selector 150 may include at least two opposes electrodes 250*a*, 250*b* that are spaced apart in a transverse direction relative to the longitudinal axis of the ion beam 250 to provide a space therebetween through which the ion bean 250 can pass. A voltage differential, e.g., a DC bias, can be applied to the electrodes 250*a*, 250*b* so as to generate an electric field in the space between the electrodes 250*a*, 250*b* in a direction perpendicular to the propagation direction of the ion beam 250 to direct (e.g., deflect) the ions along a trajectory to one of the ion traps Q4*a-e*. It will be appreciated that the electrodes 250*a*, 250*b* may include wires, rods, ion guides, or other electrical elements configured to maintain a voltage therebetween and/or range of voltages that may be selectively provided so as to change the trajectory of the ion beam 250 based on the mass range of ions in the ion beam 205 transmitted to the ion selector 150 (e.g., as known or determined based on the scan parameters of Q3). For example, the bias voltage applied to the electrodes 250*a*, 250*b* may be varied over time in order to direct ions having a certain mass range into their corresponding ion trap Q4*a-e*.

For example, during a first time duration in which ions in ion beam 205 being scanned out of Q3 and having a range of m/z (e.g., a positive range of m/z), the voltage bias ($V_{250a}-V_{250b}$) applied to the electrodes 250*a*, 250*b* may be selected to be at a first DC bias voltage (e.g., −4 Volts) that may influence the travel path of ions in ion beam 205 transmitted through the ion selector 150 such that the ions travel along ion path 210*a* toward ion trap Q4*a*. After the first time duration has expired (e.g., about 1 ms), the voltage of lens 212*a* may be set to a value configured to confine the ions transmitted into ion trap Q4*a*. Further, the voltage bias ($V_{250a}-V_{250b}$) applied to the electrodes 250*a*, 250*b* may be selected to be at a second DC bias voltage (e.g., −2 Volts) such that ions in ion beam 205 transmitted through the ion selector 150 such that the ions travel along ion path 210*b* toward ion trap Q4*b* during a second time duration. After the second time duration has expired (e.g., about 1 ms), the voltage of lens 212*b* may be set to a value configured to confine the ions transmitted into ion trap Q4*b*. Similarly, the bias voltage applied to the electrodes 250*a*, 250*b* may be configured to deflect the ion beam 250 during a third, fourth, and fifth time duration to travel along ion paths 210*c-e* to ion traps Q4*c-e*, respectively, as described for Q4*a* and Q4*b*. The voltages of lenses 212*c-e* may also be set to values configured to confine ions in ion traps Q4*c-e* following the time duration corresponding to the various mass ranges of ions.

Each mass range of ions may be scanned out of ion traps Q4*a-e* through a corresponding exit lens 112*a-e* for detection by the detecting component 114. In some embodiments, the ions confined in ion traps Q4*a-e* may be scanned in parallel and detected by the detecting component 114 at the same or substantially the same time. In this manner, the mass spectrometer system 100 may achieve, among other things, an increased data acquisition rate without negatively affecting other characteristics of the mass spectrometer system 100, such as the duty cycle and/or the mass resolution. For instance, a mass spectrometer system 100 having a multi-ion trap structure 120 with ten ion traps could realize a ten-fold increase in the data acquisition rate for analyzing ions over a range of masses without any loss in mass resolution. The ten-fold increase can be achieved because each mass range may be analyzed simultaneously, contrary to conventional methods in which each mass range is analyzed serially. In another instance, the scan rate of ions in Q3 can be increased as the resolution of this scan may be less critical the ions are being transmitted into ion traps Q4*a-e* (e.g., for further processing such as an additional mass resolving steps) and not directly to the detector 114. In some aspects, the mass resolution may be increased without effecting cycle time by decreasing the scan rate of the ions out of the plurality of traps $Q4_n$ by a factor of n (e.g., following further processing by the groups of ions in each of $Q4_n$), wherein n is the number of parallel traps. That is, each individual ion trap $Q4_n$ may be scanned at a lower scan rate while maintaining a constant or substantially constant overall cycle time. As noted above, it will be appreciated that ions confined within ion traps Q4*a-e* may be subject to additional processing, disassociation, selection, filtering, or the like.

In some embodiments, ions may be scanned out of ion traps Q4*a-e* for detection by the detecting component 114 sequentially or in parallel.

The detector 114 may be configured to detect ions being scanned from a plurality (e.g., all) of the ion traps Q4*a-e*, or the detector 114 may be a plurality of detectors configured to detect ions from one of the ion traps Q4*a-e*. For example, a single detector may be configured to detect multiple ion traps Q4*a-e* (e.g., from two adjacent ion traps Q4*a-e*). It will be appreciated that in some aspects, the plurality of detectors may be arranged in various structures in order to detect ions from the ion traps Q4*a-e*. For example, the plurality of detectors may be arranged in a circular or semi-circular arrangement surrounding the multiple ion traps Q4*a-e*. In this manner, the plurality of detectors may maximize exposure to the ion traps Q4*a-e*, while minimizing unwanted interference. In some aspects, the detector 114 may be a single detector configured to detect ions from all of the ion traps Q4*a-e*, for example, by determining which of the plurality of ion traps ejected an ion based on the location that the ion was received by the detector 114.

Figure 3:
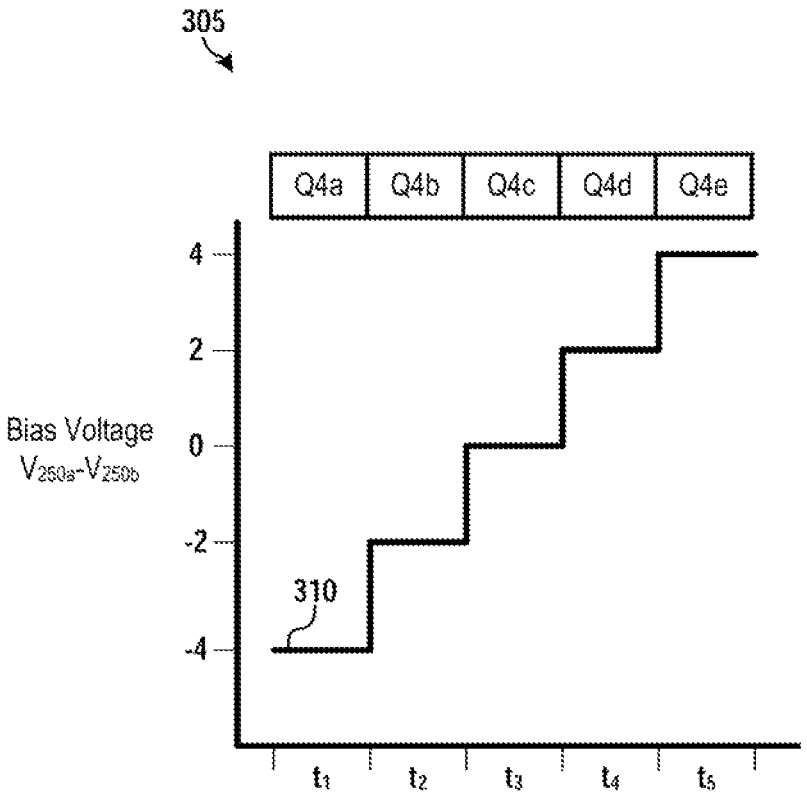
FIG. 3 depicts an illustrative timing diagram for time-based scanning according to various aspects of the applicant's teachings.

FIG. 3 depicts an illustrative timing diagram 305 for operating the multi-ion trap structure 120 of FIG. 1. At time $t_0$, ions of a mass range of interest may be confined to Q3. Ions having a mass within a first mass range (e.g., the lowest mass range) may be ejected from Q3 during time t. As such, the bias voltage ($V_{250a}-V_{250b}$) applied to the electrodes 250*a*, 250*b* may be set to −4 Volts so as to deflect positive ions in the ion beam 250 along ion path 210*a* to be confined in ion trap Q4*a* during the duration of $t_1$. During time $t_2$, ion beam 205 may comprise ions within a second mass range (e.g., the second-lowest mass range) and the bias voltage may be adjusted (e.g., −2 Volts). In this manner, during time $t_2$, ions in the ion beam 205 transmitted by the ion selector 150 could be deflected along ion path 210*b* to be confined in ion trap Q4*b*. The bias voltages applied to the electrodes 250*a*, 250*b* may similarly be changed for time durations time $t_{3-5}$ (e.g., adjusted to 0 V, 2V, and 4V) as shown in voltage curves 310 in order to influence the deflection of the ion beam 205 to travel along ion paths 210*c-e* to be confined in ion trap Q4*c-e*, respectively.

The duration of times $t_1$-$t_5$ may be sufficient such that the entirety of the ions for the respective mass range can be ejected from Q3 and into the corresponding ion trap Q4*a-e*. In some embodiments, each of time durations $t_1$-$t_5$ may have the same duration. In some embodiments, however, some or all of times $t_1$-$t_5$ may have different durations as required. The duration of times $t_1$-$t_5$ may be in a range of about 50 ms to about 100 ms.

The present teachings are not limited to the particular bias voltages and/or voltage ranges depicted in FIG. 3 (e.g., 4 Volts to −4 Volts), as these are provided for non-restrictive illustrative purposes only. Indeed, any bias voltage, range of voltages, and/or combination of voltages (including varying the bias voltage during a time duration based on the particular m/z of the ions in a mass range) may be utilized to influence the path of ions in ion beam 205 to travel to the appropriate ion trap Q4*a-e*. In addition, though the timing diagram 305 of FIG. 3 is described with reference to the multi-ion trap structure 120 of FIG. 2, embodiments are not so limited, as the bias voltages, selection and/or deflection of ions, and/or the other described aspects may be implemented using other elements, configurations, and/or techniques according to the present teachings. Furthermore, though the mass-dependent ejection of ions may be from a lowest mass to a highest mass, embodiments are not so limited as ions may be ejected from Q3 in any order.

Figure 4:
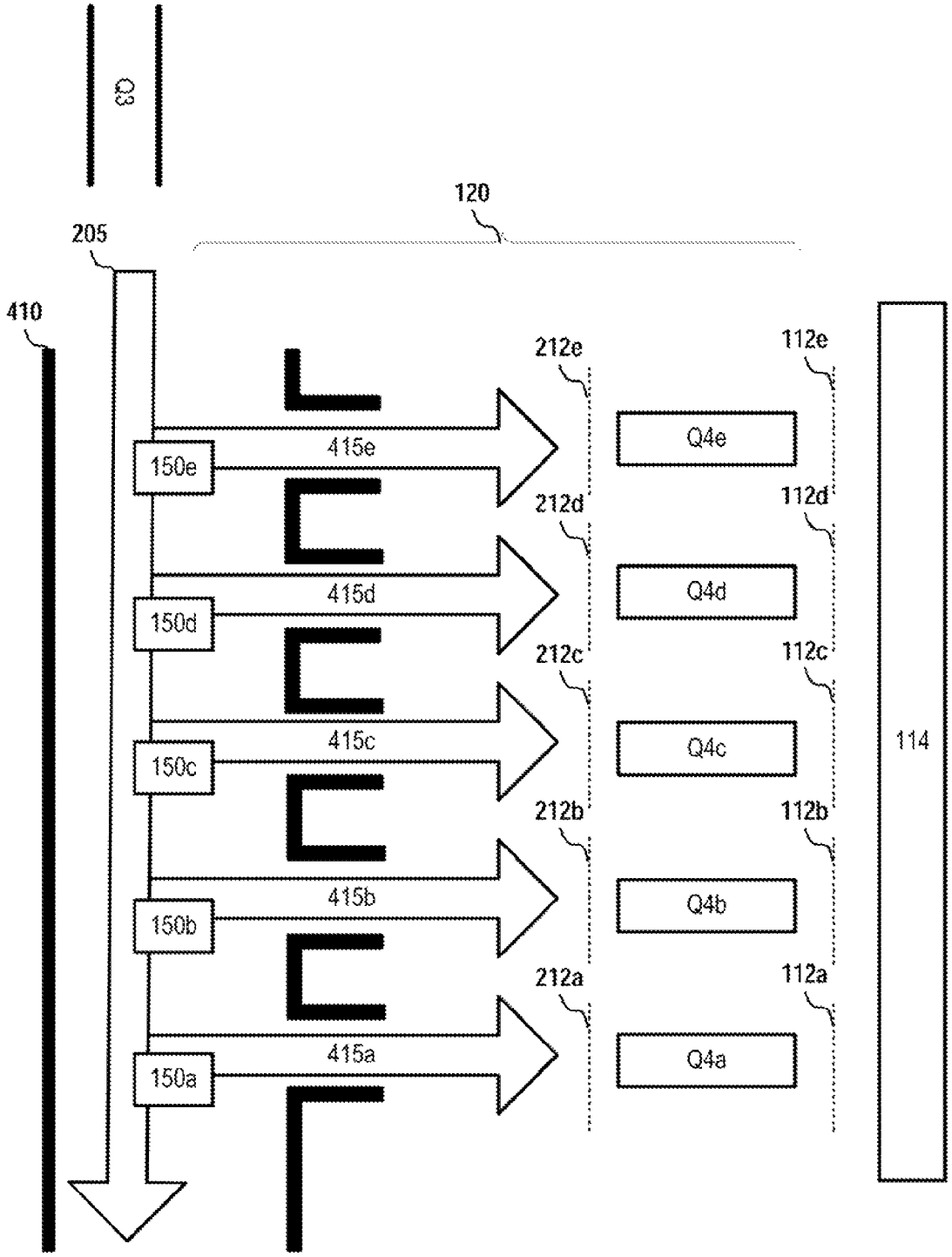
FIG. 4, in schematic diagram, depicts another exemplary multi-ion trap structure according to various aspects of the applicant's teachings.

With reference now to FIG. 4, another exemplary multi-ion trap structure according to various aspects of the present teachings is depicted. As shown in FIG. 4, ions may be ejected axially (e.g., sequentially scanned) from Q3 as ion beam 205 and into ion traps Q4*a-e* via ion paths 415*a-e*, respectively. Further, each ion trap Q4*a-e* may be associated with an ion selector 150*a-e*. The ion selectors 150*a-e* may be, without limitation, ion selectors, ion deflectors, ion mirrors, reflectrons, multipole electrical elements, ion guides, timed ion selectors (TIS), or the like that are configured to select and/or deflect ions for transmission along the ion paths 415*a-e* to the ion traps Q4*a-e*. As described above, the mass range of ions in the ion beam 205 (e.g., at a given time or duration) may be known or determined based on the scan parameters. As such, the an ion selector 150*a-e* may be activated to deflect a particular mass range of ions in ion beam 205 to travel into a selected ion trap Q4*a-e*. For instance, ion beam 205 may consist of or substantially consist of ions having a first mass range (e.g., the lowest mass range) during a first time duration. During this first time duration, the ion selector 150*a* may be activated (e.g., energized) to deflect ions in ion beam 205 to travel along ion path 415*a* and into ion trap Q4*a*, while the ion selectors 150*b-e* may be ineffective (e.g., inactive) so as not to influence the path of ions in ion beam 205. Thus, in some embodiments, only one ion selector 150*a-e* may have a voltage sufficient to deflect ions from the ion beam 205 at a time. During a second time duration in which the ion beam 205 substantially consists of ions having a second mass range (e.g., the second-lowest mass range), the ion selector 150*b* may be activated to deflect the ion beam 205 to travel along ion path 415*b* and into ion trap Q4*b*, while at least upstream ion selectors 150*c-e* are inactive (e.g., downstream ion selector 150*a* could remain active or be deactivated after the first duration). The remaining mass ranges of ions ejected from Q3 may be similarly deflected by ion selectors 150*c-e* along ion paths 415*c-e* and into ion traps Q4*c-e* as described with reference to ion traps Q4*a* and Q4*b*, above. In some embodiments, ions confined within ion traps Q4*a-e* may be subject to additional processing, disassociation, selection, filtering, or the like.

Figure 5:
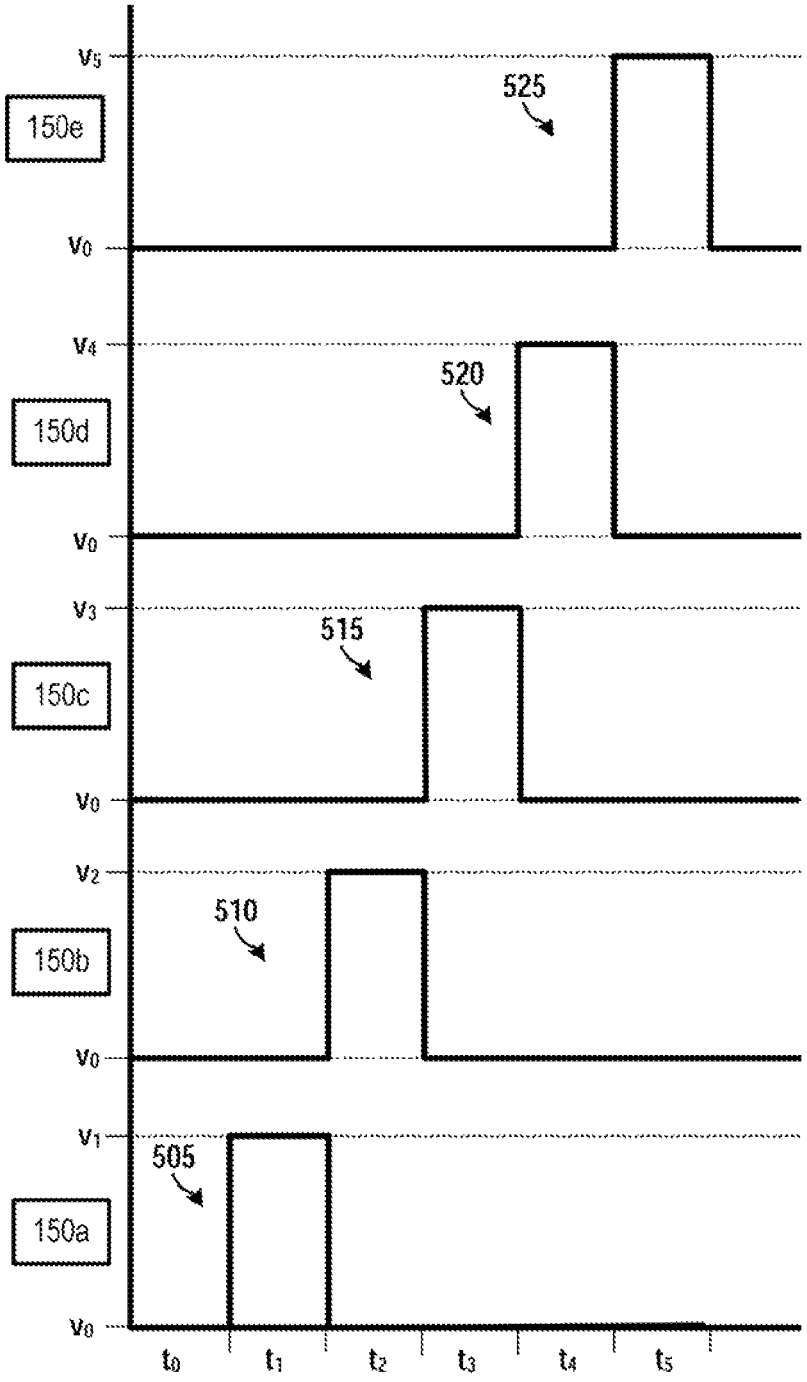
FIG. 5 depicts illustrative timing diagrams for time-based scanning according to some embodiments.

FIG. 5 depicts an illustrative timing diagram for operating the exemplary multi-ion trap structure 120 of FIG. 4. At time $t_0$, ions having a mass range being analyzed by the mass spectrometer system 100 (e.g., about 30 Daltons to about 1000 Daltons) may be confined to Q3. During time $t_1$, when the lowest mass range of ions may be ejected from Q3 in ion beam 205, the voltage of ion selector 150*a* may be increased to $v_1$ so as to deflect the lowest mass range of ions in ion path 205 to travel along ion path 415*a* and into ion trap Q4*a*. The voltage of ion selectors 105*a-e* may remain at $v_0$ for the duration $t_1$ so as not to deflect ions in ion beam 205 during $t_1$. During time $t_2$, when the second-lowest mass range of ions may be ejected from Q3 in ion beam 205, the voltage of ion selector 150*b* may be increased to $v_2$ for the duration of $t_2$ so as to deflect the second lowest mass range of ions to travel along ion path 415*b* and into ion trap Q4*b*. The voltage of ion selectors 105*a* and 150*c-e*, or at least 150*c-e*, may remain at $v_0$ for the duration $t_2$ so as not to deflect ions in ion beam 205 during $t_2$. The voltage of ion selectors 150*c-e* may be similarly increased during time durations $t_{3-5}$ as depicted in FIG. 5 so as to deflect ions in ion beam 205 into the corresponding ion traps Q4*c-e*. In some embodiments, voltages $v_{1-5}$ may have the same value, different values, or some combination thereof. For instance, $v_1$ may be the lowest voltage as this voltage is being used to deflect the lowest mass range of ions, $v_2$ may be the second lowest voltage as this voltage is being used to deflect the second lowest mass range of ions, and so on to $v_5$, which may be the highest voltage as this voltage is being used to deflect the highest mass range of ions.

Although the timing diagram 505 of FIG. 5 is described with reference to the multi-ion trap structure 120 of FIG. 4, embodiments are not so limited, as the differential voltages, selection and/or deflection of ions, and/or other described aspects may be implemented using other elements, configurations, and/or techniques according to present teachings.

Figure 6:
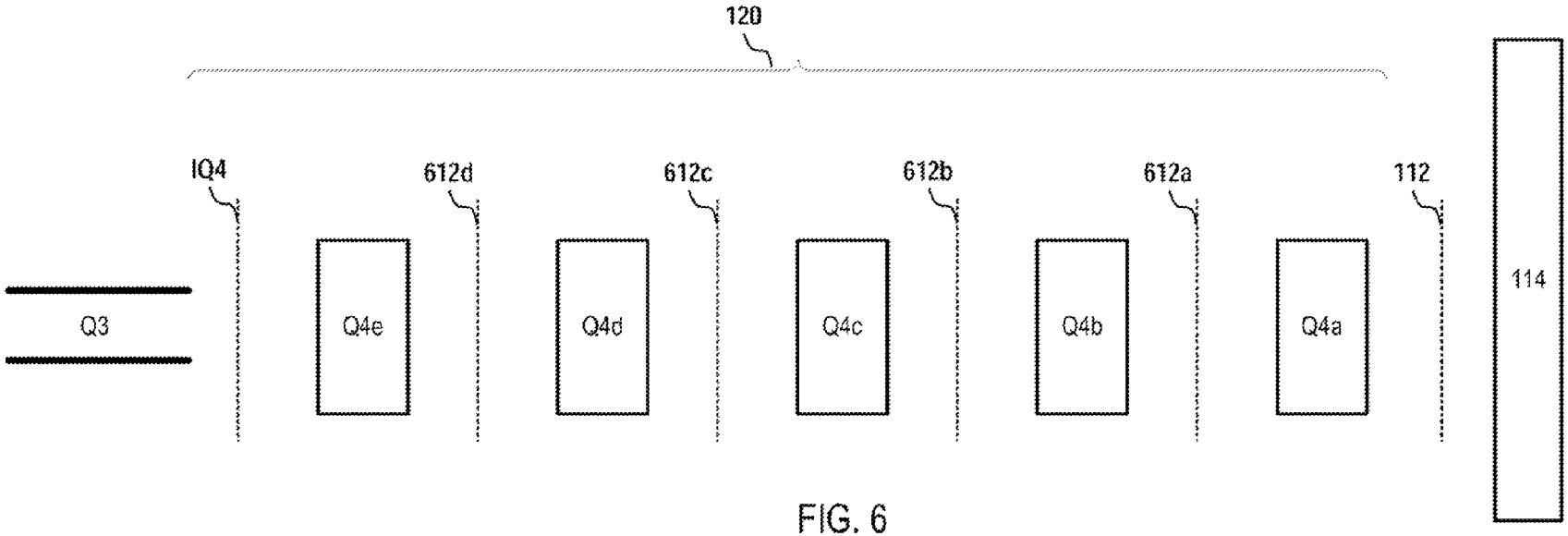
FIG. 6, in schematic diagram, depicts another exemplary multi-ion trap structure according to various aspects of the applicant's teachings.
Figure 7:
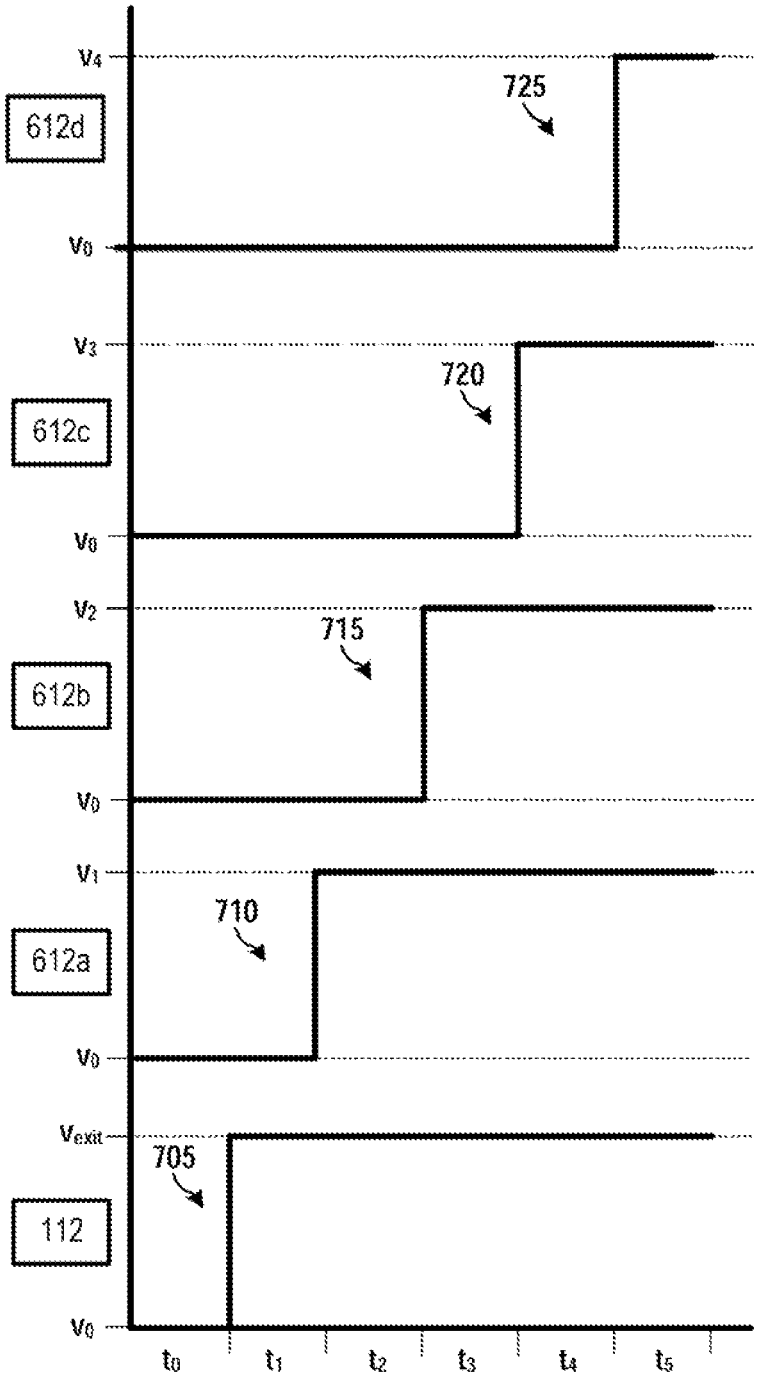
FIG. 7 depicts illustrative timing diagrams for time-based scanning according to various aspects of the applicant's present teachings.

With reference now to FIG. 6, another exemplary multi-ion trap structure according to various aspects of the present teachings is depicted. As shown in FIG. 6, ions may be sequentially (e.g., mass-selectively) ejected axially from Q3 and into and/or through one or more ion traps Q4*a-e*. FIG. 7 depicts an illustrative timing diagrams for operating the filling of the multi-ion structure 120 of FIG. 6.

Referring to FIGS. 6 and 7, at time $t_0$, ions of a mass range of interest may be confined to Q3. Ions having a first mass range (e.g., the lowest mass range) may then be ejected from Q3 (e.g., via MSAE) into Q4*a* (e.g., and through Q4*b-e*) during time duration $t_1$, during which the voltage of exit lens 112 may be set (e.g., $V_{exit}$) to prevent ions from being transmitted to the detector 114. After the expiration of duration $t_1$, the voltage of lens 612*a* may be set to $v_1$ to confine (e.g., gate-off) the ions received in ion trap Q4*a* and to prevent ions being ejected from Q3 after time $t_1$ from reaching ion trap Q4*a*. In this manner, ions having the lowest range mass may be confined to ion trap Q4*a*. After the expiration of duration $t_2$, the voltage of lens 612*b* may be set to $v_2$ to confine (e.g., gate-off) the next lowest mass range of ions ejected from Q3 (e.g., and through Q4*c-e*) in ion trap Q4*b* and to prevent ions being ejected from Q3 after time $t_2$ from reaching ion trap Q4*b*. In this manner, ions having the second lowest range mass may be confined to ion trap Q4*b*. As shown in FIG. 7, the voltages of lenses 612*c-e* may be similarly increased to voltages $v_{3-4}$ in order to confine ions of an appropriate mass range within ion traps Q4*c-d*. Similarly, after Q3 is emptied, the voltage on the lens IQ4 can be adjusted to confine the last group of ions within Q4*e*. In some embodiments, lenses 112, 612*a-d*, and IQ4 may be used in association with an RF voltage and/or a DC voltage.

The ions confined in ion traps Q4*a-e* may be transmitted to the detector 114 using various techniques, for example, radial ejection through slits in the confining electrodes using dipole/quadrupole excitation or parametric excitation.

It will be appreciated that various of the above-disclosed features and functions, or alternatives thereof, may be desirably combined into many other different systems or applications. It will also be appreciated that various presently unforeseen or unanticipated alternatives, modifications, variations or improvements therein may be subsequently made by those skilled in the art which alternatives, variations and improvements are also intended to be encompassed by the following claims.

The invention claimed is:

1. A method for processing ions in a mass spectrometer system, comprising:

a. confining a plurality of ions in an accumulation ion trap;

b. sequentially transmitting a first group of ions of the plurality of ions from the accumulation ion trap into a first ion trap and a second group of ions of the plurality of ions from the accumulation ion trap into a second ion trap different from the first ion trap, wherein the first group of ions comprises ions having a mass range different than the second group of ions;

c. confining the first group of ions in the first ion trap;

d. confining the second group of ions in the second ion trap; and e. simultaneously transmitting ions out of the first ion trap and the second ion trap for detection by at least one detector component.

2. The method of claim 1, wherein the step of sequentially transmitting the first group of ions and the second group of ions from the accumulation ion trap further comprises:

a. sequentially transmitting a third group of ions of the plurality of ions from the accumulation ion trap into a third ion trap different from the first and second ion traps, wherein the third group of ions comprise ions having a mass range different than the first and second group of ions;

b. confining the third group of ions in the third ion trap; and c. transmitting ions out of the third ion trap for detection by the at least one detector simultaneous with the transmission of ions out of the first ion trap and the second ion trap.

3. The method of claim 1, wherein sequentially transmitting the first group of ions and the second group of ions comprises mass selectively scanning the accumulation ion trap so as to eject the ions along an ion beam pathway.

4. The method of claim 3, further comprising:

a. deflecting the first group of ions from the ion beam pathway into the first ion trap; and b. deflecting the second group of ions from the ion beam pathway into the second ion trap.

5. The method of claim 4, further comprising selectively adjusting a deflector disposed in the ion beam pathway to deflect the first group of ions into the first ion trap and the second group of ions into the second ion trap.

6. The method of claim 5, wherein the deflector is selectively adjusted based on a time duration indicating a mass range of the plurality of ions being transmitted from the accumulation ion trap.

7. The method of claim 5, further comprising activating a lens to focus the ion beam pathway on the deflector.

8. The method of claim 5, further comprising:

a. selectively activating a first deflector disposed in the ion beam pathway to deflect the first group of ions into the first ion trap; and b. selectively activating a second deflector disposed in the ion beam pathway to deflect the second group of ions into the second ion trap.

9. The method of claim 1, wherein the plurality of ions in the accumulation ion trap are sequentially transmitted using one of mass selective axial ejection and mass selective radial ejection.

10. The method of claim 1, wherein ions are sequentially transmitted from the accumulation ion trap from one of a lowest mass range to a highest mass range and a highest mass range to a lowest mass range.

11. A mass spectrometer system, comprising:

a. an ion source configured to generate a plurality of ions;

b. an accumulation ion trap configured to trap the plurality of ions generated by the ion source;

c. a first ion trap configured to receive a first group of ions of the plurality of ions transmitted by the accumulation ion trap;

d. a second ion trap configured to receive a second group of ions of the plurality of ions transmitted by the accumulation ion trap;

e. at least one detector for detecting ions transmitted from at least one of the first and second ion traps; and f. a controller in electrical communication with one or more power supplies to apply voltages to the accumulation ion trap and the first and second ion traps to:

i) sequentially transmit the first group of ions from the accumulation ion trap into the first ion trap and the second group of ions from the multipole ion trap into the second ion trap, wherein the first group of ions comprises ions having a mass range different than the second group of ions; and ii) simultaneously transmit ions out of the first ion trap and the second ion trap for detection by the at least one detector.

12. The system of claim 11, further comprising a third ion trap, wherein the controller is in electrical communication with one or more power supplies to apply voltages to the accumulation trap and the third ion trap to sequentially transmit a third group of ions of the plurality of ions from the accumulation ion trap into the third ion trap different from the first and second ion traps, wherein the third group of ions comprise ions having a mass range different than the first and second group of ions, wherein ions are transmitted out of the third ion trap for detection by the at least one detector simultaneously with the transmission of ions out of the first ion trap and the second ion trap.

13. The system of claim 11, further comprising at least one deflector disposed in an ion beam pathway along which the first group of ions and the second group of ions are transmitted by the accumulation ion trap, wherein the controller is in electrical communication with one or more power supplies to adjust the at least one deflector to deflect the first group of ions from the ion beam pathway into the first ion trap and deflect the second group of ions from the ion beam pathway into the second ion trap.

14. The system of claim 13, wherein the at least one deflector comprises a pair of electrodes having a DC bias applied therebetween.

15. The system of claim 14, wherein the controller is in electrical communication with one or more power supplies to adjust the at least one deflector so as to deflect the first group of ions from the ion beam pathway into the first ion trap by maintaining a first DC bias between said electrodes and to deflect the second group of ions from the ion beam pathway into the second ion trap by maintaining a second DC bias between said electrodes.

* * * * *